US007515862B2

(12) United States Patent
Shida et al.

(10) Patent No.: US 7,515,862 B2
(45) Date of Patent: Apr. 7, 2009

(54) SHEET MOISTURIZING APPARATUS AND IMAGE FORMING SYSTEM

(75) Inventors: Toshio Shida, Higashiyamato (JP); Hirofumi Kayahara, Hachioji (JP); Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/714,851

(22) Filed: Mar. 7, 2007

(65) Prior Publication Data

US 2007/0242987 A1 Oct. 18, 2007

(30) Foreign Application Priority Data

Apr. 13, 2006 (JP) ..... 2006-110556

(51) Int. Cl.
*G03G 15/00* (2006.01)
*G03G 15/20* (2006.01)

(52) U.S. Cl. ..... 399/341; 399/406

(58) Field of Classification Search ..... 347/102; 399/341, 390, 406, 407
See application file for complete search history.

(56) References Cited

U.S. PATENT DOCUMENTS 5,434,029 A * 7/1995 Moser ..... 430/97
5,605,777 A * 2/1997 Ando et al. ..... 430/124.15
5,678,157 A * 10/1997 Yoshida et al. ..... 399/390
5,987,301 A * 11/1999 Acquaviva ..... 399/406
6,052,553 A 4/2000 Acquaviva et al.

FOREIGN PATENT DOCUMENTS

| | | |
|---|---|---|
| JP | 61-23068 | 1/1986 |
| JP | 04-112043 | 4/1992 |
| JP | 2000-356872 | 12/2000 |
| JP | 2002-283768 | 3/2002 |
| JP | 2006-8282 | 1/2006 |

OTHER PUBLICATIONS

Office Action from Japanese Patent Office dated Apr. 23, 2008, 3 pages.
English translation of the Office Action from Japanese Patent Office dated Apr. 23, 2008, 4 pages.
Office Action from Japanese Patent Office mailed Aug. 12, 2008, 2 pages.
English translation of the Office Action from Japanese Patent Office mailed Aug. 12, 2008, 2 pages.

* cited by examiner

*Primary Examiner*—David M Gray
*Assistant Examiner*—Ryan Gleitz
(74) *Attorney, Agent, or Firm*—Finnegan, Henderson, Farabow, Garrett & Dunner, L.L.P.

(57) ABSTRACT

A sheet moisturizing apparatus, including a vertical conveyance route in which a sheet is guided upward or downward and paired moisturizing units which are mounted symmetrically to sandwich the vertical conveyance route.

3 Claims, 7 Drawing Sheets

SHEET MOISTURIZING APPARATUS AND IMAGE FORMING SYSTEM

This application is based on Japanese Patent Application No. JP2006-110556 filed on Apr. 13, 2006, with the Japanese Patent Office, the entire content of which is hereby incorporated by reference.

TECHNICAL FIELD

The present invention relates to a sheet moisturizing apparatus which applies water to a sheet, and an image forming system in which the same apparatus is provided.

BACKGROUND OF THE INVENTION

As is well known, image formation conducted by an electro-photographic process incorporates the process in which a toner image is formed via electrostatic charge, exposure and development, the formed toner image is transferred onto a recording sheet and the toner image transferred onto the sheet is fixed to form a permanent image.

In this fixing process, when toner is melted by heat and pressure to fix the image onto the sheet, some water evaporates from a paper sheet due to the heat. Further, after the fixing, the sheet is open to the outside air, and thereby reabsorbs water from the outside air.

Since such evaporation and re-absorbance of water between the front and reverse surfaces of the paper sheet tends to occur at a different rate, it results in waving or curling of the sheet, which of course is a major problem.

Generally, a fixed paper sheet shows various phenomena. FIG. 1(*a*) shows wavy sheet S3 in which the printed surface is convexly and concavely curled. FIG. 1(*b*) shows a sheet which is convexly curled upward, which hereinafter is referred to as "convexly curled sheet S1", while FIG. 1(*b*) shows a sheet in which the printed surface is convexly curled downward, which hereinafter referred to as "concavely curled sheet S2". The conveyance direction of the sheet is shown by an arrow in FIG. 1(*a*), 1(*b*) and 1(*c*).

These phenomena generate various problems. In the case of post-processes conducted on the sheet which carries a formed image, problems occur during conveyance and processing of the sheet, and in the case of binding process, a book of bound curled sheets becomes very thick, which result in deterioration in quality of the final product. Further, when such sheets are ejected from the apparatus, they do not stack orderly. Accordingly, measures to count such wavy and curled sheets are required.

In Unexamined Japanese Patent Application Publication 61-23,068, to overcome the problem of the wavy or curled sheets, the sheet is moisturized via a mist of water. A moisturizing apparatus incorporating a moisturizing roller is shown, to effectively control the water supply, to reduce any adverse effects due to the water mist on various sections adjacent to the moisturizing apparatus, and to downsize the apparatus.

Moisturizing flattens wavy and curled sheet, but it curls the sheet again if water is not applied equally to both surfaces of the sheet.

Specifically, if more water is applied onto one surface than the other surface, the former expands more than the latter, and a convex curl is generated on wetter surface.

In U.S. Pat. No. 6,052,553, a moisturizing apparatus is shown in which moisturizing rollers are provided on and under the horizontal conveyance route through which the sheet is fed. The upper and lower moisturizing rollers apply water to both surfaces of the sheet. In this apparatus, water is supplied to the upper and lower moisturizing rollers from respective water tanks.

In the case water is applied onto both surfaces of the sheet, due to the water routes from the surface of the water tank, serving as the water source, to the contact position of the moisturizing roller and the sheet, the upper moisturizing means and the lower moisturizing means are not equal, which makes it very difficult to apply equal amounts of water onto both surfaces of the sheet.

Even if water is equally applied onto both surfaces by adjustment, the supplied water amount changes during operation, which causes curled sheets. Further, in above-mentioned moisturizing apparatus, more than three rollers are required for the water supply route, which result in a larger apparatus.

In Unexamined Japanese Patent Application Publication 2006-8,282, a moisturizing apparatus is proposed in which paired moisturizing rollers convey the sheet horizontally, and apply water onto both surfaces of the sheet. A water tank, provided under the lower moisturizing roller, supplies water to the lower moisturizing roller, but the upper moisturizing roller is via the lower moisturizing roller.

In this apparatus, the applied water amount from the upper roller to the sheet tends to be lower than that of the lower roller, which causes the curled sheet.

In these apparatuses, the sheet is conveyed horizontally as it is moisturized. As shown in FIG. 2, since water applied to the sheet moves vertically due to gravity, the amount of water changes in accordance with the direction of thickness, and curling tends to be generated. In FIG. 2, moisture particles in sheet S are schematically shown by solid black dots w.

SUMMARY OF THE INVENTION

According to one aspect of the invention, a sheet moisturizing apparatus, which includes a vertical conveyance route in which a sheet is guided upward or downward, and paired moisturizing units which are mounted symmetrically to sandwich the vertical conveyance route.

DESCRIPTION OF THE PREFERRED EMBODIMENT

Figure 1:
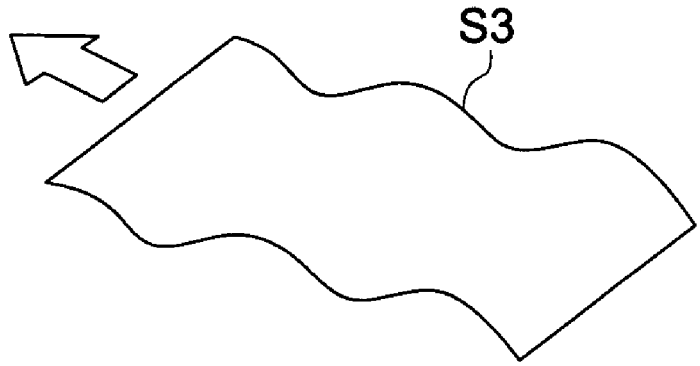
FIG. 1(*a*) shows a wavy sheet S3, FIG. 1(*b*) shows a convexly curled sheet S1, and FIG. 1(*c*) shows a concavely curled sheet S2.
Figure 1:
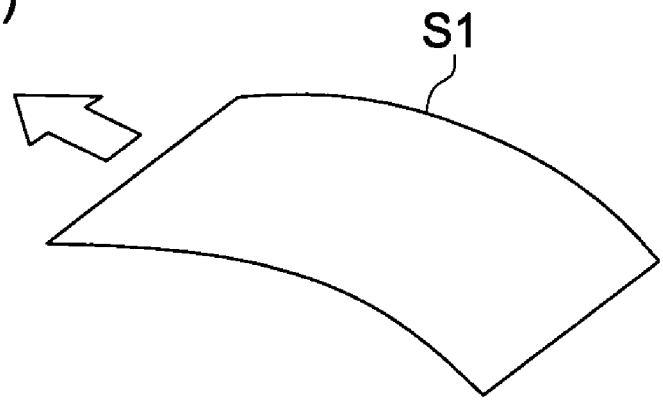
Figure 1:
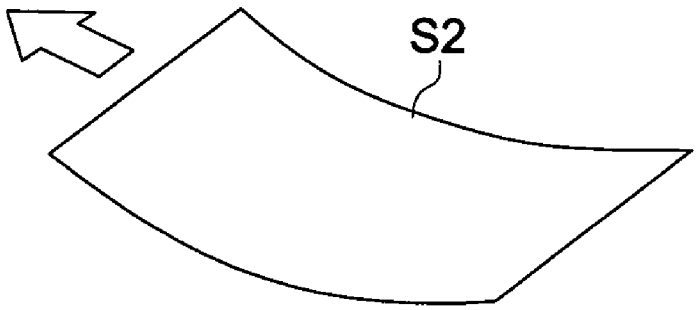
Figure 2:
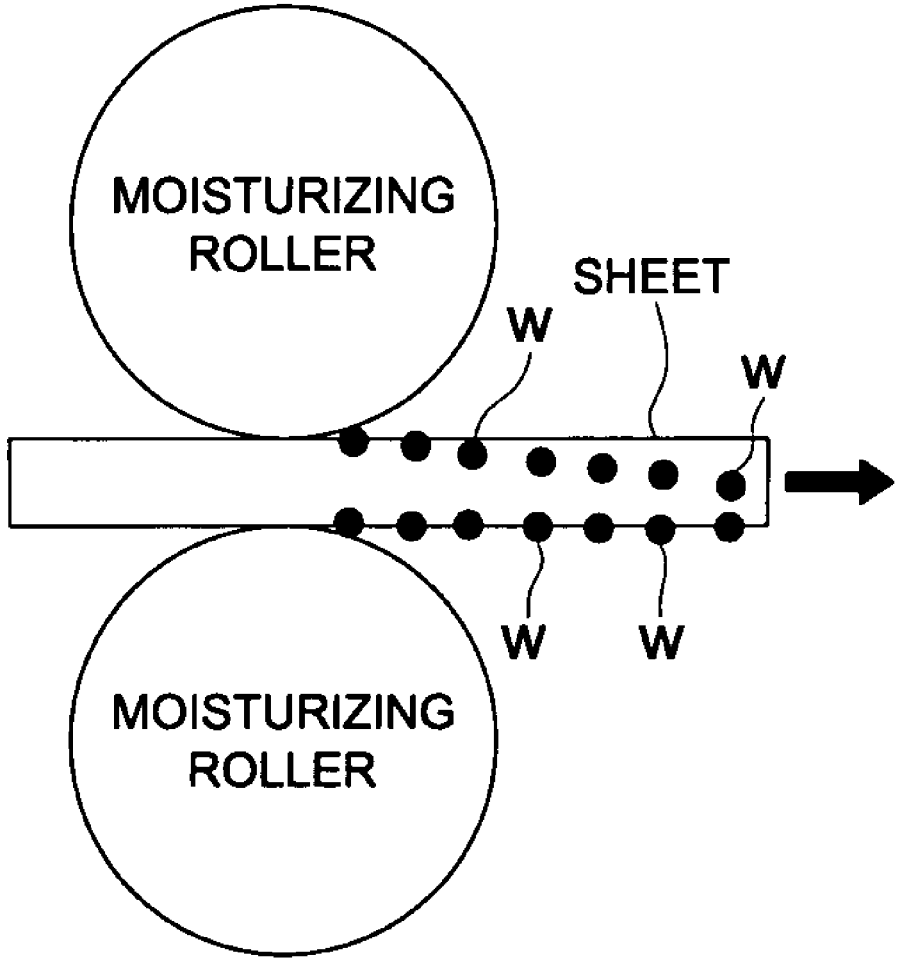
FIG. 2 schematically shows migration of moisture within the sheet.

The present invention will now be detailed, while referring to the drawings, which however is not limited to the present embodiment.

Figure 3:
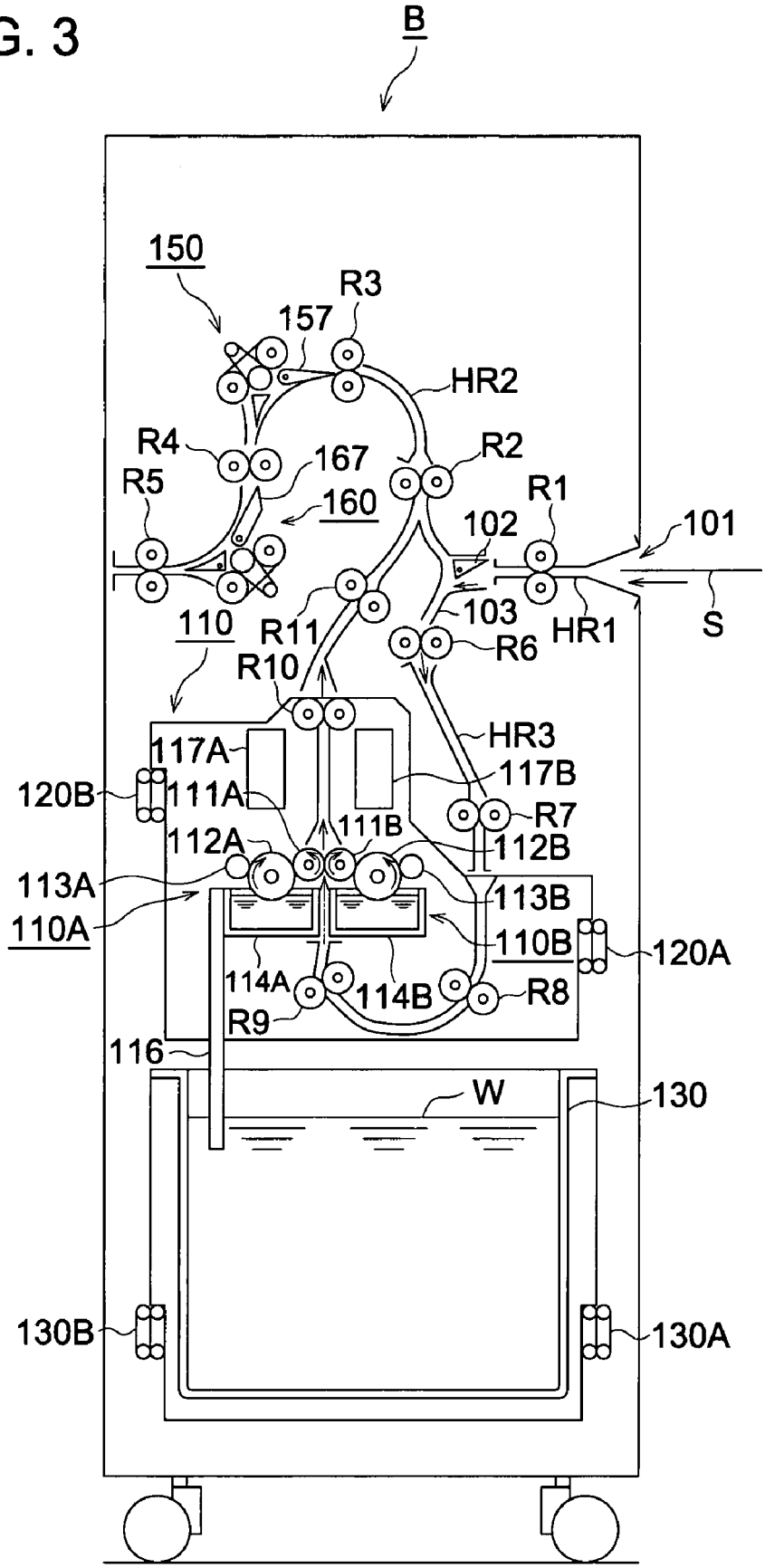
FIG. 3 is an overall view of sheet moisturizing apparatus B of the present embodiment.

FIG. 3 is an overall view of sheet moisturizing apparatus B relating to the present embodiments.

Sheet S carrying the image which was formed by an image forming apparatus (which is to be detailed later) is introduced to route HR1 from entrance 101 of sheet moisturizing apparatus B, after sheet S is conveyed through selected route HR2 or HR3 to be processed, sheet S is discharged from sheet moisturizing apparatus B.

In both a non-decurling mode in which sheet S is not moisturized in sheet moisturizing apparatus B and a first decurling mode in which sheet S is mechanically flattened but is not moisturized, sheet S is conveyed through routes HR1 and HR2.

On the other hand, in both a moisturizing mode in which the sheet is moisturized but is not mechanically flattened, and a second decurling mode in which sheet S is moisturized and mechanically flattened, sheet S is conveyed through routes HR1 and HR3 and a portion of route HR2. Route HR2 or HR3 is selected by changeover gate 102.

Mechanical decurling sections 150 and 160 are provided on route HR2. Mechanical decurling section 150 flattens concavely curled sheet S2, and mechanical decurling section 160 flattens convexly curled sheet S1. "Convex curl" means that the surface of sheet S is convexly curved upward, while "concave curl" means that the surface of sheet S is convexly curved downward, which are illustrated in FIGS. 1(*b*) and 1(*c*), as well as FIG. 6.

In FIG. 3, moisturizing unit 110 is provided on route HR3. Moisturizing unit 110 can be withdrawn by an operator from sheet moisturizing apparatus B, being guided by rails 120A and 120B.

In route HR1, sheet S is conveyed by paired rollers R1, while in route HR2, sheet S is conveyed by paired rollers R2-R5. In route HR3, sheet S is conveyed by paired rollers R6-R11.

Main tank 130, provided under moisturizing unit 110 to supply it with water, can be partially pulled out from sheet moisturizing apparatus B, being supported and guided by rails 130A and 130B.

Figure 4:
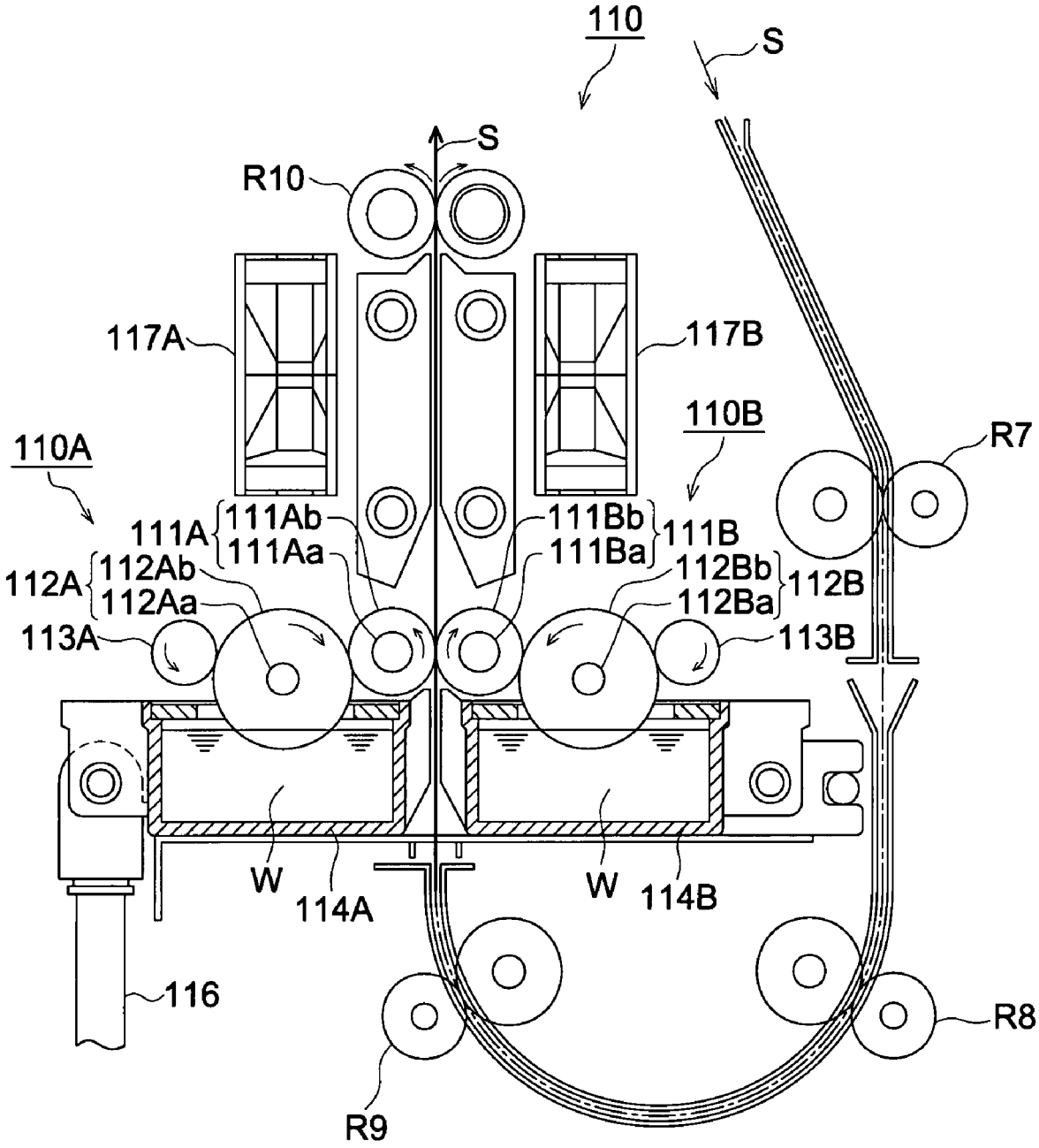
FIG. 4 is an enlarged view of moisturizing unit 110 of sheet moisturizing apparatus B.

FIG. 4 is an enlarged view of moisturizing unit 110 of sheet moisturizing apparatus B. Moisturizing apparatus B includes moisturizing unit 110 and main tank 130.

In FIG. 3, after sheet S enters horizontally route HR1, it is directed downward from route HR1 to U-shaped route HR3 by changeover gate 102, and then turns upward at a U-shaped section of rote HR3. Moisturizing unit 110 is positioned to sandwich a portion of route HR3, through which sheet S is conveyed upward. Moisturizing rollers 111A and 111B are mounted to contact each other.

Moisturizing unit 110, refer to FIG. 4, is formed of paired and opposed moisturizing sections, which are left side moisturizing section 110A and right side moisturizing section 110B. Left side moisturizing section 110A is structured of moisturizing roller 111A, water supplying roller 112A and water supplying tank 114A, serving as a water supplying section, while right side moisturizing section 110B is structured of moisturizing roller 111B, water supplying roller 112B and water supplying tank 114B. Moisturizing rollers 111A and 111B are in contact with each other, and rotate as shown by respective arrows to convey sheet S and to supply simultaneously water to sheet S. In addition, it is also possible to form water supplying sections to supply water to water supply rollers 112A and 112B by employing water tanks and integral transit rollers, in a such a way that the transit rollers are mounted between water supplying roller 112A and water supplying tank 114A, and also between water supplying roller 112B and water supplying tank 114B.

Water supplying roller 112A is in contact with moisturizing roller 11A, while water supplying roller 112B is in contact with moisturizing roller 111B. Water supplying roller 112A is partially submerged in water W of water supplying tank 114A, while water supplying roller 112B is partially submerged in water W of water supplying tank 114B.

Control member 113A squeezes water supplying roller 112A to regulate the water content of water supplying roller 112A, while control member 113B squeezes water supplying roller 112B to regulate the water content of water supplying roller 112B.

Moisturizing rollers 111A and 111B, as well as water supplying rollers 112A and 112B are formed of single layered or double layered elastic members, such as non-foamed solid rubber and foamed rubber, or formed of double layered rubbers on which a textile is wrapped. Moisturizing roller 111A is structured of metallic core 111Aa and rubber layer 111Ab layered on the same, while moisturizing roller 111B is structured of metallic core 111Ba and rubber layer 111Bb layered on the same. Water supplying roller 112A is structured of metallic core 112Aa and rubber layer 112Ab formed on the same, while water supplying roller 112B is structured of metallic core 112Ba and rubber layer 112Bb formed on the same.

Control members 113A and 113B are round bars which rotate or do not rotate. Flat blades may also be used for control members.

In FIG. 3, water W stored in main tank 130 is pumped up to water supplying tanks 114A and 114B by a pump which is not illustrated, and any overflow in each tank returns to main tank 130 through overflow tube 116, whereby an adequate water level in water supplying tanks 114A and 114B is secured in the same way. In addition, water supplying tanks 114A and 114B are connected to each other, whereby water in both tanks remains at the same level.

During the water supplying process, moisturizing rollers 111A and 111B, as well as water supplying rollers 112A and 112B rotate as shown by arrows to supply water to each side of sheet S.

Moisturizing roller 111A and water supplying roller 112A are symmetrically arranged with moisturizing roller 111B and water supplying roller 112B with respect to route HR3 as shown in FIG. 4. Therefore, the form and the length of the water supplying path from water supplying tank 114A to moisturizing roller 111A is the same as those of a water supplying path from water supplying tank 114B to moisturizing roller 111B.

Accordingly, an equal amount of water is supplied to both sides of sheet S. Further, since sheet S is moisturized in vertical route HR3, an equal amount of water is supplied onto sheet S in the direction of the thickness of sheet S, which preferably maintains the flatness of sheet S.

Figure 5:
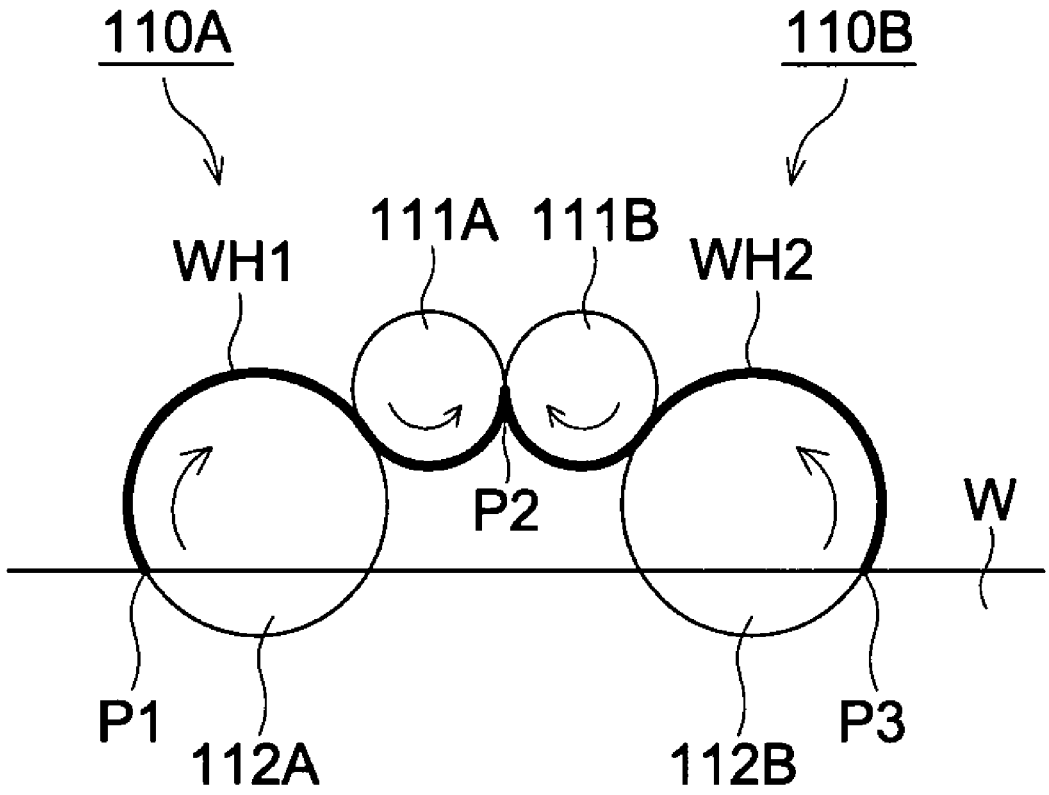
FIG. 5 is an enlarged view of roller members of moisturizing unit 110, which explains a moisturizing function.

The moisturizing function of moisturizing unit 110 will be detailed while referring to FIG. 5.

In moisturizing section 110A, water supplying roller 112A separates from the water surface at area P1. Moisturizing roller 111A comes into contact with sheet S at area P2. Water supplying roller 112B separates from the water surface at area P3. Moisturizing roller 111B comes into contact with sheet S at area P2. Distance WH1 is measured from P1 to P2 over the moisturized surfaces of water supplying roller 112A and moisturizing roller 111A. Distance WH2 is measured from P3 to P2 over the moisturized surfaces of water supplying roller 112B and moisturizing roller 111B. Distance WH1 is equal to distance WH2, and the shapes of these distances are the same, but mirror images, which are illustrated by heavy S-curved lines in FIG. 5. Accordingly, the amount of water, which is applied to sheet S by moisturizing roller 111A, is equal to that applied by moisturizing roller 111B. Further, even when the conditions of moisturizing rollers 111A and 111B, and the conditions of water supplying rollers 112A and 112B are changed by duration, the ratio of water absorbance of both surfaces is not changed.

Accordingly, equivalent amounts of water are applied onto both surfaces of sheet S, which conduct long and stable moisturizing process.

In FIG. 4, fans 117A and 117B blow drying air onto both surfaces of sheet S, which allow extra water in sheet S to evaporate immediately after the water supply so that parts mounted in the conveyance route, such as rollers, are prevented from being covered with water.

In addition, in the above explanation of the embodiment, sheet S is fed vertically upward, and paired and opposed moisturizing sections 110A and 110B are mounted on both sides of the conveyance route. However, it is also possible to have paired and opposed moisturizing sections 110A and 110B on both sides of the conveyance route oriented downward. Further, paired moisturizing sections are not necessarily mounted at perfectly symmetrical positions. That is, as long as they are practically symmetrical, small changes can be ignored. For example, the heights of both moisturizing sections need not be absolutely the same.

Figure 6:
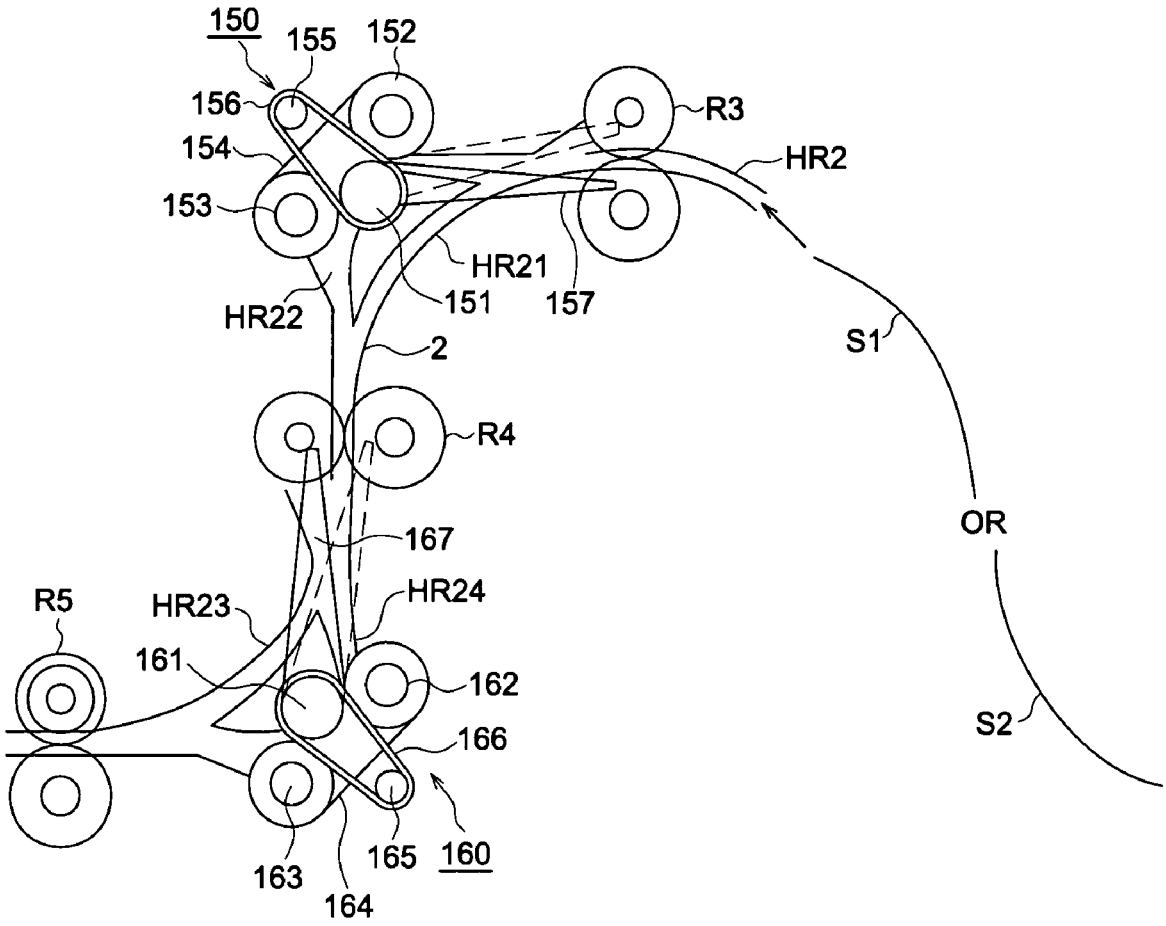
FIG. 6 is an enlarged view of mechanical decurling sections 150 and 160 of sheet moisturizing apparatus B.

FIG. 6 is an enlarged sectional view of decurling sections 150 and 160.

Decurling section 150 is structured of small diameter roller 151 (having a radius of 7 mm, for example), paired belt driven rollers 152 and 153, and belt 154 entraining about belt driven rollers 152 and 153. Spring 156 is entrained about shaft 155 and small diameter roller 151, and allows small diameter roller 151 to press against belt 154.

Changeover gate 157 switches the conveyance routes of sheet S, when changeover gate 157 exists at the dotted position in FIG. 6, route HR21 is selected through which sheet S can not enter decurling section 150, while when changeover gate 157 exists at the solid-line position, route HR22 is selected through which sheet S enters decurling section 150.

Since route HR21 has a large curvature radius, for example 60 mm, as shown in FIG. 6, when sheet S passes through route HR21, no decurling operation is conducted. On the other hand, when sheet S passes through route HR 22 formed of small diameter roller 151 and belt 154, sheet S is decurled by bending force generated by small diameter roller 151 and belt 154. That is, a concavely curled sheet S2 is returned to be a flat sheet.

Next, decurling section 160 is structured of small diameter roller 161 (having a radius of 7 mm, for example), paired belt driven rollers 162 and 163, and belt 164 entraining about belt driven rollers 162 and 163. Coiled spring 166 is entrained about shaft 165 and small diameter roller 161, and allows small diameter roller 161 to press against belt 164.

Changeover gate 167 switches the conveyance routes of sheet S, when changeover gate 167 exists as at the dotted-line position in FIG. 6, route HR23 is selected through which sheet S does not enter decurling section 160, while when changeover gate 167 exists as at the solid-line position, route HR24 is selected through which sheet S enters decurling section 160.

Since route HR23 has a large curvature radius for example, 60 mm, as shown in FIG. 6, when sheet S passes through route HR23, no decurling is conducted. On the other hand, when sheet S passes through route HR 24, sheet S is decurled by bending force generated by small diameter roller 161 and belt 164. That is, convexly curled sheet S1 is returned to its original flat sheet state.

Using sheet moisturizing apparatus B, the operator can select an operation mode from among: a non-decurling mode which does not reform sheet S, a moisturizing mode which moisturizes sheet S without using a bending force, a first decurling mode which flattens sheet S using the bending force, but not moisturizing, and a second decurling mode which flattens sheet S using a bending force after moisturizing.

In the non-decurling mode, route HR2 is selected by changeover gate 102 shown in FIG. 3, and routes HR 21 and HR23 are selected by changeover gates 157 and 167, respectively, through which sheet S is conveyed.

In the moisturizing mode, route HR 3 is selected by changeover gate 102 shown in FIG. 3, and routes HR 21 and HR23 shown in FIG. 6 are selected by changeover gates 157 and 167, respectively. After sheet S2 passes through routes HR1 and HR3 in FIG. 3, sheet S2 is moisturized by moisturizing unit 110, then sheet S2 enters route HR2 through paired rollers R2, and further passes through routes HR21 and HR23 to be ejected out of sheet moisturizing apparatus B.

The first decurling mode, in which sheet S is mechanically decurled without water, includes a concave-decurling mode which flattens the concavely curled sheet (which is sheet S2 in FIG. 6) and a convex-decurling mode which flattens the convexly curled sheet (which is sheet S1 in FIG. 6).

In the concave-decurling mode, after route HR2 is selected by changeover gate 102 shown in FIG. 3, route HR22 is selected by changeover gate 157, and route HR23 is selected by changeover gate 167 shown in FIG. 6.

Accordingly, concavely curled sheet S2 passes through the selected routes which are HR2, HR22 and HR23, and is reformed to the original flat sheet state by decurling section 150, after which flattened sheet S2 is ejected out of sheet moisturizing apparatus B.

In the convex-decurling mode, after route HR2 is selected by changeover gate 102 shown in FIG. 3, route HR21 is selected by changeover gate 157 shown in FIG. 6, as well as route HR24 is selected by changeover gate 167.

Accordingly, convexly curled sheet S1 passes through the selected routes which are HR2, HR21 and HR24, and is returned to its original flat sheet state by decurling section 160, after which flattened sheet S1 is ejected out of sheet moisturizing apparatus B.

The second decurling mode in which sheet S is mechanically decurled and water content is controlled, also includes a concave-decurling mode (which decurls sheet S2 in FIG. 6) and a convex-decurling mode (which decurls sheet S1 in FIG. 6)

In the concave-decurling mode, after route HR3 is selected by changeover gate 102 shown in FIG. 3, route HR22 is selected by changeover gate 157, and route HR23 is selected by changeover gate 167 shown in FIG. 6.

Accordingly, concavely curled sheet S2 passes through route HR3, after which it is moisturized by moisturizing unit 110, and is reformed to be its original flat sheet state by decurling section 150, then flattened sheet S2 is ejected out of sheet moisturizing apparatus B.

In the convex-decurling mode, after route HR3 is selected by changeover gate 102 shown in FIG. 3, sheet S1 passes through route HR2 and route HR21 which is selected by changeover gate 157 shown in FIG. 6, and further passes through route HR24 which is selected by changeover gate 167.

Accordingly, convex curled sheet S1 passes through route HR3, after which it is moisturized by moisturizing unit 110, and is reformed to be its original flat sheet state by decurling section 160, then flattened sheet S1 is ejected out of sheet moisturizing apparatus B.

Figure 7:
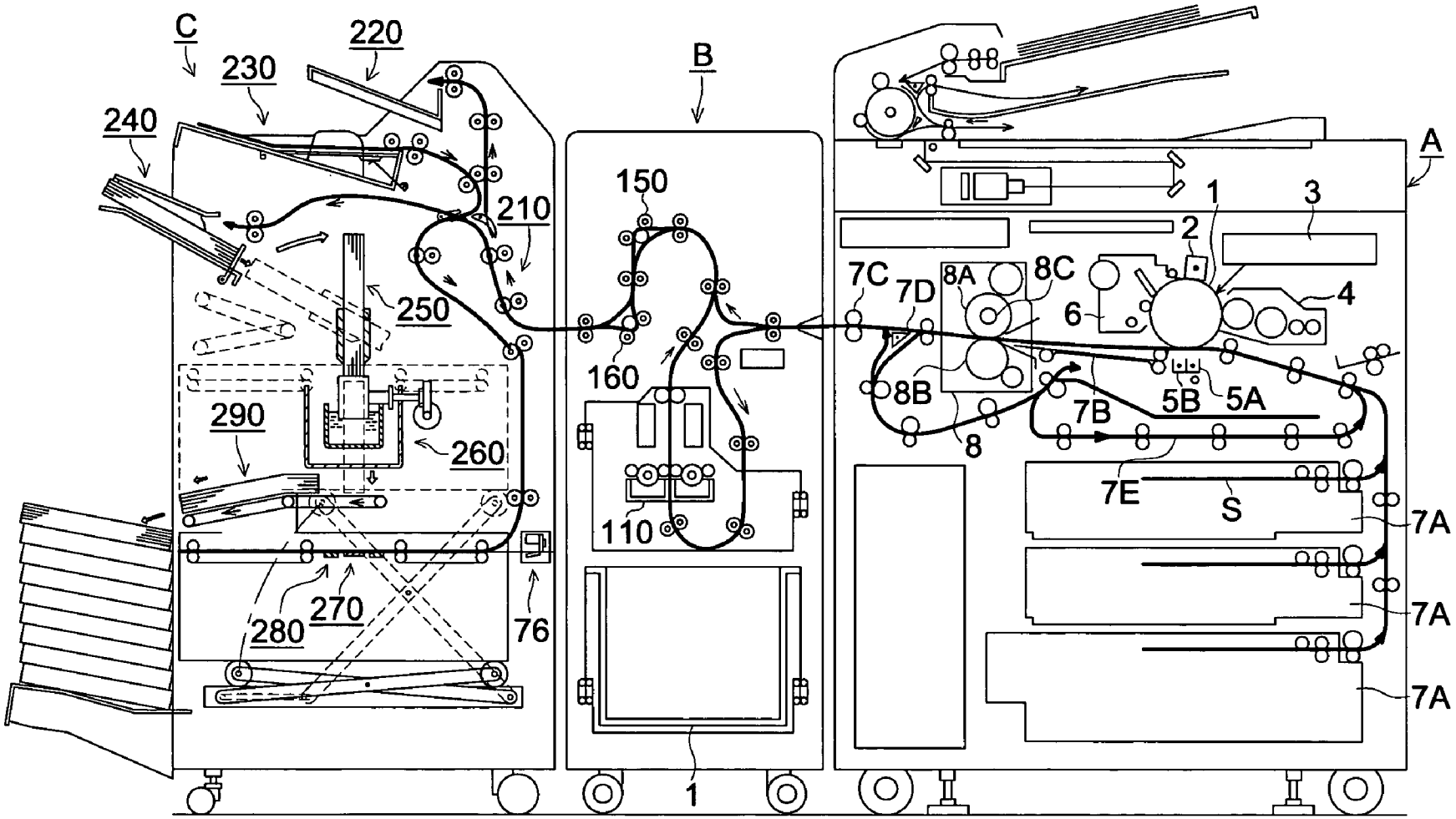
FIG. 7 is a total structural view of the image forming system relating to the present embodiment of the present invention.

FIG. 7 shows a total structure of an image forming system including: image forming apparatus A, sheet moisturizing apparatus B and book binding apparatus C which is a sheet post-processing apparatus, relating to the embodiment of the present invention.

Image forming apparatus A incorporates an image forming section which includes: charging section 2, image exposure section 3 (which is a writing section), developing section 4, transfer section 4, discharging section 5B and cleaning section 6, all of which are mounted around image carrier 1. In the image forming section, after the surface of image carrier 1 is evenly charged by charging device 2, which is scanned by laser beam generated by image exposure device 3 based on the image data which are read from the document, whereby latent images are formed on the surface of image carrier 1. The latent images are developed by developing section 4, and form the reversal toner image on the surface of image carrier 1.

Sheet S, which is supplied from sheet accommodating section 7, is conveyed to a transfer position. At the transfer position, the above toner images are transferred by transfer section 5A onto sheet S. After electrical charges on the reverse side of Sheet S are neutralized by discharging section 5B, sheet S carrying the toner images separates from image carrier 1, and is conveyed to conveyance section 7B, further, sheet S is heat-fixed by fixing section 8, and then ejected by paired ejecting rollers 7C into sheet moisturizing apparatus B.

In addition, fixing section 8 includes heat roller 8A, pressure applying roller 8B to press against heat roller 8A, and heater 8C. The unfixed toner images are heated by heat roller 8A, which is heated by heater 8C, whereby deposited toner for forming the toner images is melted and fixed on sheet S.

In the case of the double-sided image formation on sheet S, which has been heat-fixed by fixing section 8, is branched from an ordinal ejecting route by route changeover plate 7D, sheet S is flipped over in reverse conveyance section 7E, and again conveyed to the image forming section. After images are formed on the reverse side of sheet S, sheet S is reconveyed to fixing section 8, and ejected by paired ejecting rollers 7C from image forming apparatus A into sheet moisturizing apparatus B.

Concerning image carrier 1, after the images are processed, any remaining toner on its surface is removed by cleaning section 6, and image carrier 1 stands-by for the next image formation.

In sheet moisturizing apparatus B, sheet S is controlled based on the selected mode, such as the non-decurling mode which does not reform sheet S, the moisturizing mode which moisturizes sheet S but does not use bending force, the first decurling mode which flattens sheet S using bending force without supplying water to sheet S, and the second decurling mode which flattens sheet S using bending force after sheet S is moisturized.

The operator selects any of these modes using an operation section (which is not illustrated) of image forming apparatus A, or instructions sent via a network from an outer apparatus can be used to select the mode.

Book binding apparatus C is structured of sheet conveyance section 210, sheet ejecting section 220, cover supplying section 230, printed sheets accommodating section 240, printed sheets conveyance section 250, pasting section 260, cover attaching section 270, cover folding section 280, and book ejecting section 290, all of which are vertically oriented in book binding apparatus C.

When sheets S are to be ejected without being bound, the route directing to printed sheets accommodating section 240 is closed, and the route directing to sheet ejecting section 220 is opened.

When printed sheets S are to be bound, sheets S are sequentially stacked on a predetermined position of printed sheets accommodating section 240, whereby a stack of the printed sheets S is formed, which includes predetermined number of pages. The stack of the printed sheets S on sheets accommodating section 240 is conveyed to stacked sheets supporting section 250, and section 250 rotates and stands vertically, then glue is applied onto the edge of the stacked sheets by pasting section 260.

Next, a cover sheet is supplied from cover supplying section 230 to be attached onto the stack by cover attaching section 270, and the cover is folded by cover folding section 280 to become a book.

The book is then ejected by book ejecting section 290 from book binding apparatus C.

Additionally, book binding apparatus C is further detailed in JP 2003-209,869.

One or more embodiments of the invention can be provided advantages that, since water is applied to both sides of a vertically conveying sheet, both surfaces of the sheet receive equal amounts of water, resulting in no curling. Further, since water is applied equally to both sides of the sheet over a long term, a moisturizing apparatus capable of stable operation can be realized.

What is claimed is:

1. A sheet moisturizing apparatus configured to decurl a sheet carrying a fixed image, comprising:

a vertical conveyance route; and a changeover gate configured to control whether the sheet is guided downward to a moisturizing area or upward to bypass the moisturizing area;

wherein the moisturizing area comprises paired moisturizing sections, which are mounted symmetrically to sandwich the vertical conveyance route, each having:

a water supplying tank configured to store water, a water supplying roller configured to receive water from the water supplying tank, a moisturizing roller configured to receive the water from the water supplying roller and supply the water to the sheet, and a control member configured to regulate the water being supplied from the water supplying roller to the moisturizing roller, and contact the water supplying roller.

2. The sheet moisturizing apparatus of claim 1, wherein a distance from the water supplying tank to a moisturizing area of the moisturizing roller is equal in each moisturizing section.

3. An image forming system, comprising:

an image forming apparatus including an image forming section which forms an image on a sheet and a fixing section which fixes the image on the sheet by applying heat;

a sheet moisturizing apparatus configured to decurl the sheet which has passed through the image forming apparatus, including:

a vertical conveyance route; and a changeover gate configured to control whether the sheet is guided downward to a moisturizing area or upward to bypass the moisturizing area;

wherein the moisturizing area comprises paired moisturizing sections, which are mounted symmetrically to sandwich the vertical conveyance route, each having:

a water supplying tank configured to store water, a water supplying roller configured to receive water from the water supplying tank, a moisturizing roller configured to receive the water from the water supplying roller and supply the water to the sheet, and a control member configured to regulate the water being supplied from the water supplying roller to the moisturizing roller, and contact the water supplying roller; and a sheet post processing apparatus, wherein the sheet moisturizing apparatus is installed between the image forming apparatus and the sheet post processing apparatus.

* * * * *